US007694859B1

(12) United States Patent
Whittaker

(10) Patent No.: US 7,694,859 B1
(45) Date of Patent: Apr. 13, 2010

(54) FLIP HANGER

(76) Inventor: Lance Whittaker, 1147 W. Swan Dr., Chandler, AZ (US) 85248

( * ) Notice: Subject to any disclaimer, the term of this patent is extended or adjusted under 35 U.S.C. 154(b) by 154 days.

(21) Appl. No.: 12/009,513

(22) Filed: Jan. 18, 2008

Related U.S. Application Data

(60) Provisional application No. 60/881,567, filed on Jan. 22, 2007.

(51) Int. Cl.
*A41D 27/22* (2006.01)

(52) U.S. Cl. ..... 223/94; 223/92

(58) Field of Classification Search ..... 223/85, 223/88, 89, 90, 92, 94
See application file for complete search history.

(56) References Cited

U.S. PATENT DOCUMENTS

| | | | | | |
|---|---|---|---|---|---|
| 2,290,722 | A | * | 7/1942 | Weingarten | 223/94 |
| 2,588,235 | A | * | 3/1952 | Herrick | 223/90 |
| 2,736,474 | A | * | 2/1956 | Janik | 223/90 |
| 4,717,053 | A | | 1/1988 | Wang | |
| 4,948,019 | A | * | 8/1990 | Rodum | 223/94 |
| 5,007,562 | A | * | 4/1991 | Brink et al. | 223/89 |
| 5,102,019 | A | * | 4/1992 | Lam | 223/94 |
| 5,397,037 | A | * | 3/1995 | Ozawa | 223/94 |
| 5,480,076 | A | * | 1/1996 | Siegel et al. | 223/94 |
| 5,690,257 | A | | 11/1997 | Ward | |
| 5,826,759 | A | * | 10/1998 | Ohsugi | 223/85 |
| 5,979,721 | A | * | 11/1999 | Curtis | 223/94 |
| 6,540,121 | B1 | | 4/2003 | Harvey | |
| 2006/0054646 | A1 | | 3/2006 | Nathanmanna | |

* cited by examiner

*Primary Examiner*—Gary L Welch
*Assistant Examiner*—Nathan E Durham
(74) *Attorney, Agent, or Firm*—Harpman & Harpman

(57) ABSTRACT

A collapsible hanger used for garments having a hanger hook with a pair of oppositely disposed support arms pivotally secured thereto. Deployment control cable straps extend from the respective arms for folding and use deployment of the hanger arms via a central slidably disposed lock and release knob on a central support shaft in the preferred form of the embodiment. An alternate form is also available which shows an automatic spring-urged deployment system in which the hanger arms are retracted under spring tension and then released via an access button into full horizontally disposed use position.

4 Claims, 3 Drawing Sheets

FLIP HANGER

This application claims the benefit of U.S. Provisional Application No. 60/881,567, filed on Jan. 22, 2007.

BACKGROUND OF THE INVENTION

1. Technical Field

This invention relates to closet hangers that are used to hang garments in a wrinkle free storage position by a central hook.

2. Description of Prior Art

Prior art devices of this type have been directed to folding and collapsible garment hangers in which the hanger arms are hinged to a central support element or to one another, see for example U.S. Pat. Nos. 4,717,053, 5,690,257, 6,540,121 and U.S. Publication 2006/0054646 A1.

In U.S. Pat. No. 4,717,053 a foldable hanger can be seen having a pair of independent pivoting hanger arms on a central hook support bracket.

U.S. Pat. No. 5,690,257 discloses a folding hanger for garments having a pair of arms pivoted together at their base with one arm having an integral hanger hook extending therefrom.

U.S. Pat. No. 6,540,121 claims a collapsible garment hanger with spring elements extending to a pair of pivoted arms.

U.S. Patent Publication 2006/0054646 A1 is directed to a rotary folding hanger configuration with a planetary gear engageable on and between geared hanger arm elements for annular rotational deployment of arms in co-vector orientation.

SUMMARY OF THE INVENTION

A collapsible hanger configuration which provides multiple use storage criteria having a pair of oppositely disposed adjustable garment support arms pivotally secured to a central support shaft. In the primary form of the invention, cables or straps are used to electively and manually deploy the respective arms from folded position to an up horizontally oppositely disposed use position. An alternate form of the invention, as noted, has an automatic spring-urged gliding sleeve configuration in which pivoted linkage assembly interconnects to the pivoted hanger arms and upon deployment by an activation button will swing upwardly locking in place until released.

DETAILED DESCRIPTION OF THE INVENTION

Figure 1:
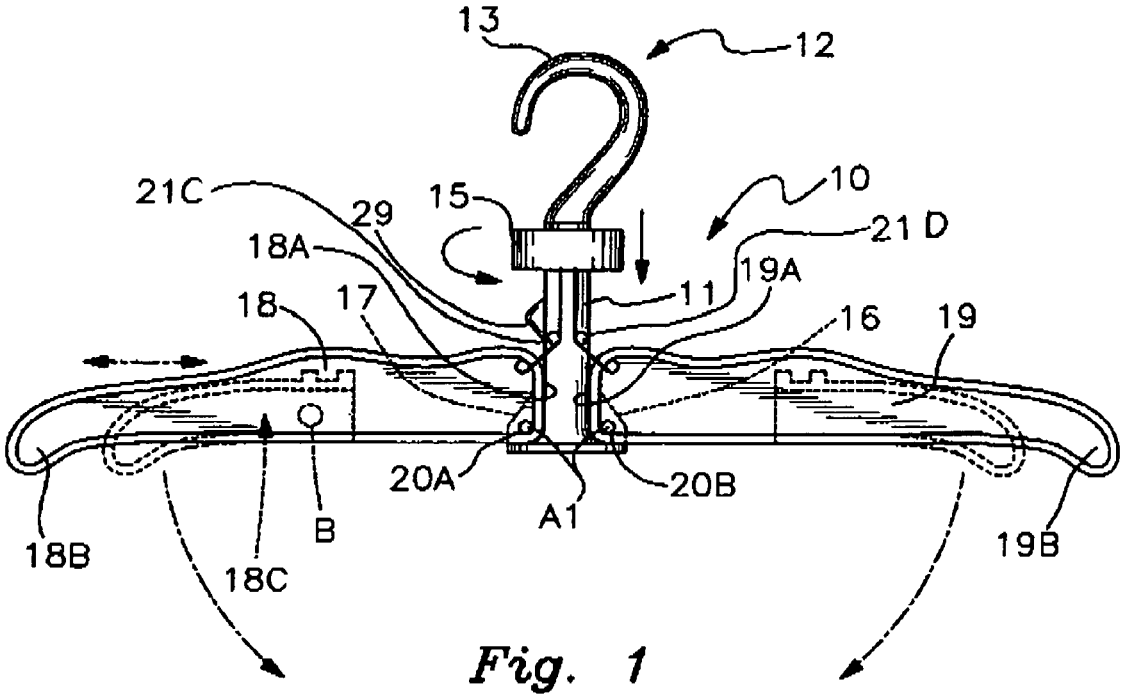
FIG. 1 is a side elevational view of the hanger device in open use position.

Referring to FIG. 1 of the drawings, a folding hanger 10 of the invention can be seen having a main support shaft 11 with a vertical extending hanger hook portion 12 being of a typical contoured curved hook configuration 13 with a return portion 14 as will be well understood by those skilled in the art.

A locking and release knob 15 is registerably positioned on the shaft 11 in spaced relation to the hereinbefore disclosed hanger hook portion 12 for selective vertical movement thereon. Oppositely disposed aperture mounting surfaces 16 and 17 extend from the shaft's free end at as best seen in FIG.

1 of the drawings in dotted lines. The apertured mounting surfaces 16 and 17 provide for pivoted attachment for a corresponding pair of hanger arms 18 and 19 extending outwardly therefrom in horizontally aligned orientation to one another when in open use position as will be disclosed in operational detail hereinafter.

Each of the hanger arms 18 and 19 have attachment ends 18A and 19A and oppositely disposed free ends 18B and 19B. The arms 18 and 19 are tapered longitudinally which is of a typical hanger arm configuration well known to those skilled in the art. The arms may be longitudinally adjustable for length by a sliding extension button B activating select fixtures 18C and 19C shown in broken lines on the hanger arms 18 and 19 for illustration understanding.

Figure 2:
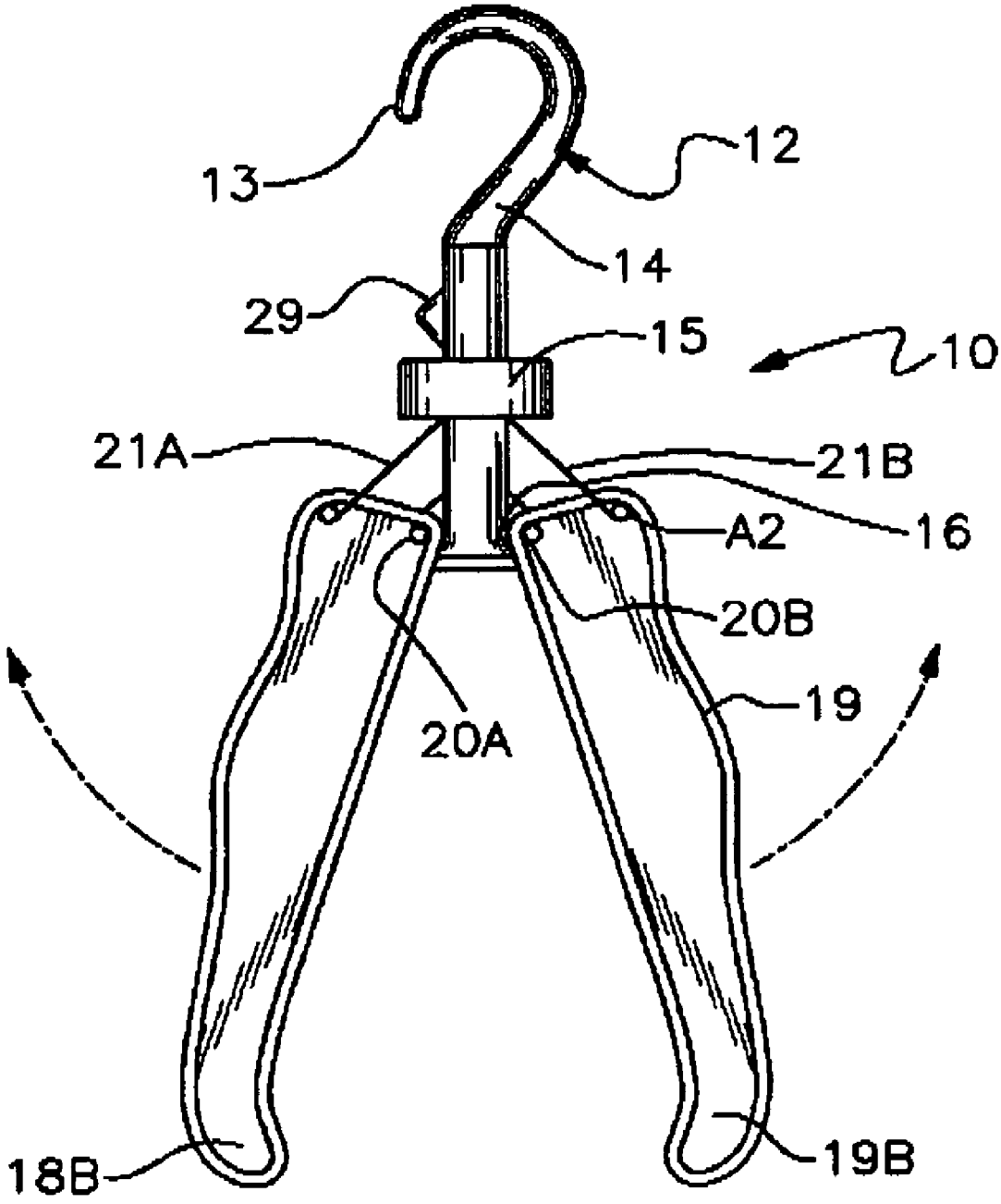
FIG. 2 is a side elevational view in folded close position.
Figure 3:
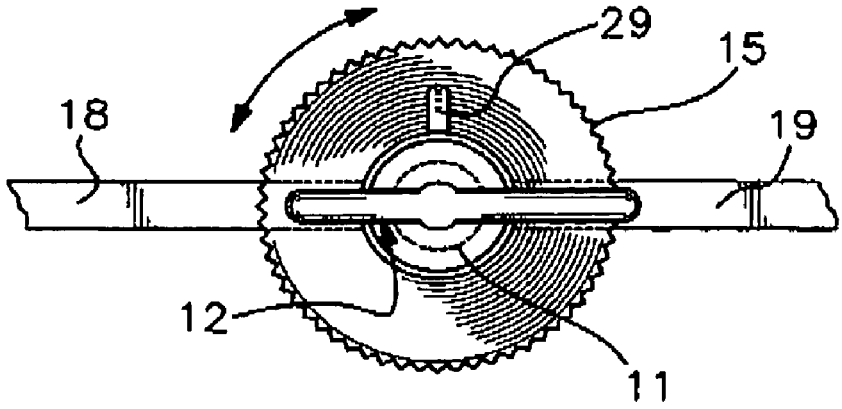
FIG. 3 is an enlarged partial top plan view with portions cut-away in open use position.

The hanger arms 18 and 19 are pivotally secured to the respective apertured mounting surfaces 16 and 17 of the shaft 11 via a corresponding respective aperture A1 in their attachment ends 18A and 19A by pivot pins 20A and 20B. A pair of activation cable or straps 21A and 21B are secured through secondary apertures A2 in spaced vertical alignment with said pivoted apertures A1 in their respective hanger arms 18 and 19. The cable or straps 21A and 21B extend around respective leverage wheels 21C and 21D and are interengaged by the locking release knob 15 for selective deployment and "folding" of the hanger arms 18 and 19 as seen in FIG. 2 of the drawings. An arm release element 29 is provided for allowed activation of the release knob 15 which may also be used independently for direct arm movement as noted.

It will be seen that in use when the locking release knob 15 is in "up" locked and release position as seen in FIG. 1 of the drawings, the hanger arms 18 and 19 are deployed in extended horizontal aligned use position. By repositioning the locking and release knob 15 downwardly on the shaft 111 by various incremental restrictive features, the cable or straps 21A and 21B will allow the hanger arms 18 and 19 to pivot and "fold" downwardly as noted in FIG. 2 of the drawings for closed pre-use garment engagement position.

This allows the user, not shown, to place the folded hanger 10 of the invention into and through the neck portion of the garment, not shown, and then pull and extend the respective hanger arms 18 and 19 as hereinbefore described with the garment deploying same for preferred perfect fit use.

Figure 4:
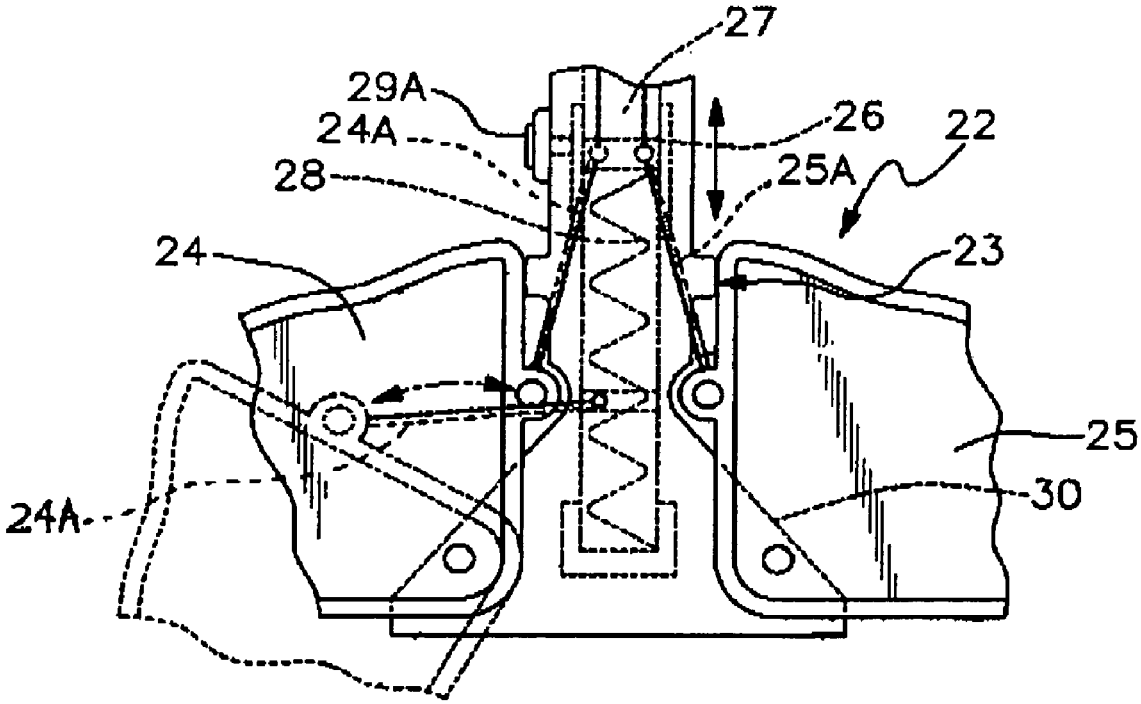
FIG. 4 is an enlarged side plan partial elevational view showing an alternate button release form of the device.

Now referring to FIG. 4 of the drawings, an alternate form of the invention can be seen generally at 22 where an automatic hanger 23 has oppositely disposed hanger arms 24 and 25 which are deployable having a pair of pivoted link armatures 24A and 25A pivotally secured to the hanger arms and to a spring urged sliding ring 26 within a central cylinder cavity 27.

A spring 28 is interengaged with an activation release button assembly 29 that will release the spring 28 from a compressed coiled set position to an extended position therewithin. The sliding ring 26 pulls the armatures 24A and 25A which pivotally follow within the opening corresponding pivot the respective hanger arms 24 and 25 from a folded position shown in broken lines generally in FIG. 4 to a deployed locked use position shown in solid lines.

It will be evident to those skilled in the art that various changes and modifications may be made thereto without departing from the spirit of the invention.

Therefore I claim:

1. A foldable extensible garment hanger comprising, a hanger support shaft, a hanger hook extending from one end thereof, a pair of hanger arms pivotally secured to opposing apertured mounting surface extending from said support shaft, an annular locking release knob rotatably positioned on said support shaft, hanger arm engagement activation cables, a release button on said hanger arm registerable with said locking release knob securing said hanger arms from a co-planar first use position to a vertical oriented parallel non-use position and extensible cable engagement therefrom to said respective arms.

2. The foldable extensible garment hanger set forth in claim 1 wherein said locking and release knob is movable from a first lock position on said support shaft to a second unlocked position.

3. A foldable extensible garment hanger comprises, a hanger support shaft, a hook extending from one end of said shaft, a pair of hanger arms pivotally secured to apertured extensions on said shaft, a pair of armatures pivotally extending from said hanger arms to a respective spring urged sliding ring within a central bore in said support shaft, a button release means interengaged with said spring urged sliding deployment rings and spring means within said bore interengaging said sliding deployment rings for selective release thereof.

4. The foldable extensible garment hanger set forth in claim 3 wherein said hanger arms extend from a first co-planar longitudinally aligned extended use position to a vertical oriented parallel non-use position.

* * * * *